US005110091A

United States Patent [19]

Engel et al.

[11] Patent Number: 5,110,091

[45] Date of Patent: May 5, 1992

[54] SCISSORS JACK WHICH HAS IMPROVED FORMED GEAR TEETH

[75] Inventors: Darryl L. Engel, LaOtto; John R. Scoville, Butler, both of Ind.

[73] Assignee: Universal Tool & Stamping Co., Butler, Ind.

[21] Appl. No.: 737,210

[22] Filed: Jul. 29, 1991

[51] Int. Cl.[5] ..... B66F 3/12

[52] U.S. Cl. ..... 254/126

[58] Field of Search ..... 254/122, 126

[56] References Cited

U.S. PATENT DOCUMENTS 4,025,054 5/1977 Yamazaki ..... 254/126

4,732,366 3/1988 Suga ..... 254/126

4,802,653 2/1989 Engel .

4,986,802 1/1991 Scoville et al. .

*Primary Examiner*—Robert C. Watson

*Attorney, Agent, or Firm*—Hill, Van Santen, Steadman & Simpson

[57] ABSTRACT

A scissors jack which has improved formed gear teeth which allow a jack to be retracted to a very low profile so that it can be placed under the vehicles. The teeth of the lower pivot arms are formed so as to extend one direction and the teeth of the upper pivot arms are formed so as to extend in the opposite direction from the teeth of the lower pivot arms so that when the jack is in the down position, the gear teeth on the upper and lower pivot arms can pass each other and thus allow the jack to have a very low contour.

6 Claims, 2 Drawing Sheets

SCISSORS JACK WHICH HAS IMPROVED FORMED GEAR TEETH

BACKGROUND OF THE INVENTION

1. Field of the Invention

This invention relates in general to scissors jack and in particular to a scissors jack which has formed gear teeth on a lower and upper pivot arms which extend on the opposite directions so that in the lower position they can pass each other thus allowing the jack to take a lower profile.

2. Description of Related Art

U.S. Pat. No. 4,802,653 which issued on FIG. 7, 1989 and U.S. Pat. No. 4,986,802 which issued on Feb. 5, 1991 relate to scissors type jacks which are assigned to the assignee of the present application.

SUMMARY OF THE INVENTION

The present invention relates to an improved scissors type jack which has formed teeth at the end of the pivot links and wherein the formed teeth on the upper and lower pivot links extend in opposite directions so that when the jack is placed in its lower most position, the upper and lower teeth will pass each other so that the jack can be retracted to a position which is lower than jacks of the prior art. This allows the jack to be placed under vehicles which have very low clearance and it also allows the jack to be lower so that it can be stored more readily than jacks of the prior art.

The upper and lower links are formed as U-shaped channels and flanges are formed on the side edges of the links and at one end thereof teeth are formed in the flanges which mate on the corresponding upper ad lower links. In the invention, the teeth in the upper and lower links are formed in opposite directions relative to each other so that they can pass each other when the jack is retracted thus allowing the jack to assume the lower profile in the retracted position. In one embodiment, the lower links are formed with flanges and teeth which extend outwardly and the upper links are formed with flanges and teeth which extend inwardly. Alternatively, the teeth on the lower links could extend inwardly and the teeth on the upper links could extend outwardly.

It is an object of the present invention to provide an improved jack which can be lowered to provide a jack having a lower profile.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figures 1, 2, 3, 3A:
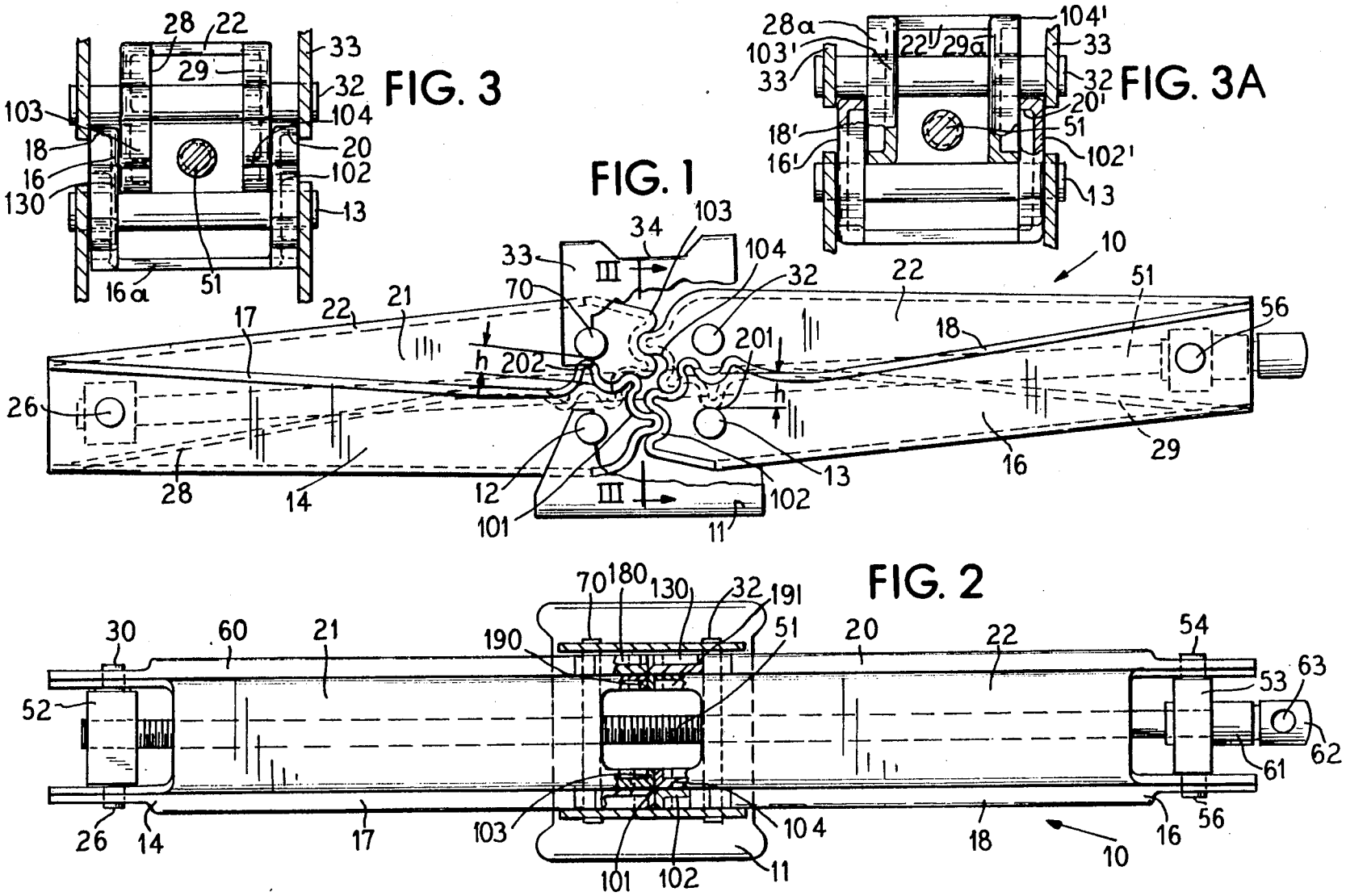
FIG. 1 is the side plan view of the invention.
FIG. 2 is a top plan view of the invention.
FIG. 3 is a sectional view taken on line III—III from FIG. 1
FIG. 3A illustrates a modification.

FIGS. 1-3 illustrate the scissors jack 10 which includes a base 11 which pivotally supports on shaft 12 and 13 lower links 14 and 16. Upper links 21 and 22 are pivotally connected to the lower links 14 and 16, respectively, by pivot pins 54 and 56 which extend from a collar block 53 and by pivot pins 26 and 30 which extend from a threaded block 52. The lead screw shaft 51 of the jack extends through the collar 53 and is threadedly received in the threaded collar 52. The shaft 51 has a collar 61 adjacent member 53 and has a flatted portion 62 which is formed with an opening 63 through which a suitable handle can be inserted so as to rotate the lead screw to extend and lower the jack 10.

The upper links 21 and 22 are pivotally connected by pivot pins 32 and 70 to a vehicle support 33 which has a depression 34 formed at its center so as to receive a portion of a vehicle. The support 33 is generally U-shaped.

At the inner ends of the lower links 14 and 16 adjacent the support 11 are formed gear teeth 101 and 102 which mesh together as the links 14 and 16 pivot about the pivot pins 12 and 13, respectively. The lower link 16 is generally U-shape and has a bottom portion which connects opposite sidewalls and a flange 18 is formed on the side wall on one side of the member 16 and a flange 20 is formed on the side wall on the other side of the member 16. Flanges extend generally outwardly from the member 16 and the gear teeth 102 are formed in the flange and extend generally outwardly from the side wall of the member 16. Gear teeth 130 are formed on the other side of the pivoted link 16 as shown in FIG. 2. The lower link 14 is also generally U-shaped and the opposite side walls are formed with flanges 17 and 60 and the teeth 101 are formed in the flange 17 as shown in FIGS. 1, 2 and 3 and mesh with the teeth 102 of the link 16. The flange 60 extends into teeth 180 which mate with teeth 130 of the lower link 16 as shown in FIG. 2. As shown in FIG. 3A the flanges 18' and 20' on members 16' and 102' may extend inwardly and the flanges 103' and 104' on members 28' and 29' may extend outward.

The upper links 21 and 22 are generally U-shaped are formed with inwardly extending flanges 29 and 28 as shown in FIG. 1 on their lower surfaces and the flanges 28 and 29 are formed into form teeth 103 and 104 which mesh together on the near side of FIG. 1. The other sides of upper links 21 and 22 are formed with flanges which are formed into teeth 190 and 191 at their inner ends.

It is to be particularly noted that the teeth on the upper links 21 and 22 extend inwardly from the outer sidewalls of the links 21 and 22 whereas the teeth formed on the lower links 14 and 16 extend outwardly relative to the links 14 and 16. The result is that when the jack is lowered to its lower most position as shown in FIG. 1, for example, the gear teeth 103 and 104 on the near side of FIG. 1 as well as the gear teeth 190 and 191 on the opposite side of the upper link pass by the gears 101 and 102 and 130 and 180 of the lower links. Since the teeth miss each other since they are laterally displaced, the tooth 201 of the gear 104 moves downwardly until it engages the pivot pin 13 as shown in FIG. 1 in dashed line. The teeth 101 move pass the teeth 103 of the upper link until the tooth 202 engages the pivot pin 70 as shown in FIG. 1. The results of offsetting the formed teeth of the upper links and the lower links in opposite direction allows the lower position of the jack 10 to be lowered by a distance "h" shown in FIG. 1. This is different in height of the support member 33 allows the jack to be placed under vehicles which have smaller clearances than those of the prior art.

FIG. 3 illustrates how the teeth on the upper link 22 pass within the teeth of lower link 16.

Figure 4:
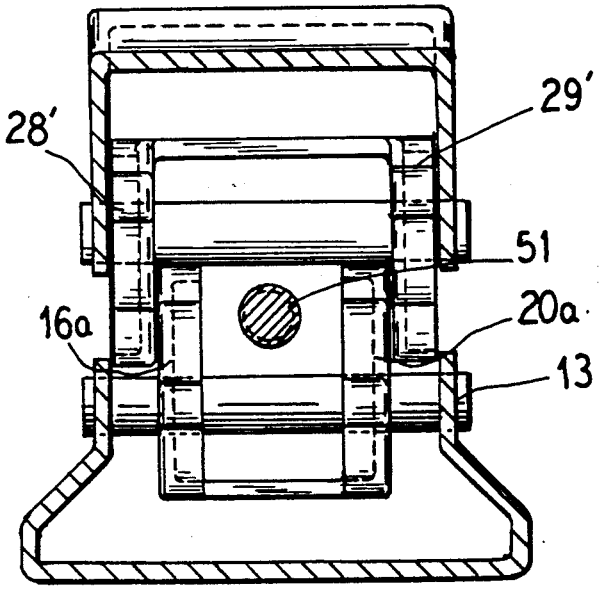
FIG. 4 illustrates a modification.

FIG. 4 illustrates a modification wherein the lower links 16*a* and 20*a* fit between the upper links 28′ and Although the invention has been described with respect to preferred embodiments, it is not to be so limited as changes and modifications can be made which are within the full intended scope of the invention as defined by the appended claims.

We claim as our invention:

1. A scissors type jack comprising, a base, a pair of lower links which have first ends pivotally attached to said base, a support member, a pair of upper links which have first ends pivotally attached to said support member, a threaded collar with opposite ends pivotally attached to second ends of first ones of said pair of upper and lower links, a block member formed with a central opening and with opposite ends pivotally attached to second ends of second ones of said pair of upper and lower links, a threaded shaft which extends through said central opening of said block member and threadedly received in said threaded collar, flanges formed on said pair of lower links and meshing gear teeth formed on said first ends on said flanges, flanges formed on said pair of upper links and meshing gear teeth formed on said first ends on said flanges, and the flanges and meshing teeth of said lower links extending in a direction which is opposite to the direction of the flanges and teeth of said upper links.

2. A scissors jack according to claim 1 wherein said flanges and meshing teeth of said lower links extend outwardly from said jack and said flanges and meshing teeth of said upper links extend inwardly from said jack.

3. A scissors jack according to claim 1 wherein said flanges and meshing teeth of said lower links extend inwardly from said jack and said flanges and meshing teeth of said upper links extend outwardly from said jack.

4. A scissors type jack according to claim 1 wherein the gear teeth on said lower links to not engage the gear teeth on said upper links when the jack is lowered to its lowest position.

5. A scissors type jack according to claim 4 wherein said gear teeth on said upper links pass inside the gear teeth on said lower links when said jack is moved to its lowest position.

6. A scissors type jack according to claim 4 wherein said gear teeth on said lower links pass inside the gear teeth on said upper links when said jack is moved to its lowest position.

* * * * *

US005110091B1

REEXAMINATION CERTIFICATE (3233rd)

United States Patent [19] [11] B1 5,110,091

Engel et al. [45] Certificate Issued Jun. 17, 1997

[54] SCISSORS JACK WHICH HAS IMPROVED FORMED GEAR TEETH

[75] Inventors: Darryl L. Engel, LaOtto; John R. Scoville, Butler, both of Ind.

[73] Assignee: Universal Tool & Stamping Co., Butler, Ind.

Reexamination Requests:
No. 90/004,421, Oct. 9, 1996
No. 90/004,224, Apr. 17, 1996

Reexamination Certificate for:

| | |
|---|---|
| Patent No.: | **5,110,091** |
| Issued: | **May 5, 1992** |
| Appl. No.: | **737,210** |
| Filed: | **Jul. 29, 1991** |

[51] Int. Cl.[6] ..... B66F 3/12
[52] U.S. Cl. ..... 256/126
[58] Field of Search ..... 254/122, 126; 29/893.33; 74/98, 457; 72/88

[56] References Cited

U.S. PATENT DOCUMENTS

| | | | |
|---|---|---|---|
| 1,536,877 | 5/1925 | Burniston . | |
| 2,580,829 | 1/1952 | Peck | 254/126 |
| 2,581,706 | 1/1952 | Rimbach | 254/126 |
| 2,861,466 | 11/1958 | Brock | 74/98 |
| 3,741,524 | 6/1973 | Morgan et al. | 254/122 |
| 4,025,054 | 5/1977 | Yamazaki . | |
| 4,055,329 | 10/1977 | Hammond | 254/126 |
| 4,732,366 | 3/1988 | Suga . | |
| 4,802,653 | 2/1989 | Engel . | |
| 4,918,961 | 4/1990 | Hill | 72/88 |
| 4,986,802 | 1/1991 | Scoville et al. . | |

*Primary Examiner*—Robert C. Watson

[57] ABSTRACT

A scissors jack which has improved formed gear teeth which allow a jack to be retracted to a very low profile so that it can be placed under the vehicles. The teeth of the lower pivot arms are formed so as to extend one direction and the teeth of the upper pivot arms are formed so as to extend in the opposite direction from the teeth of the lower pivot arms so that when the jack is in the down position, the gear teeth on the upper and lower pivot arms can pass each other and thus allow the jack to have a very low contour.

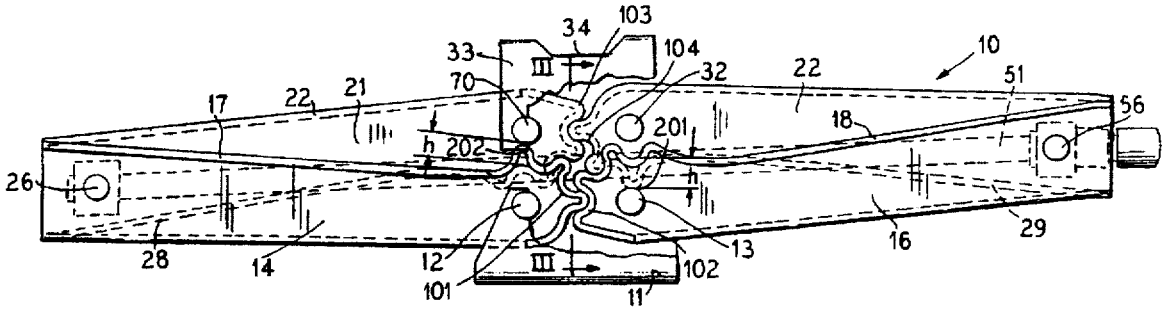

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–6 are cancelled.

New claims 7–13 are added and determined to be patentable.

*7. A scissors type jack, comprising: a base, a pair of U-shaped lower links having a bottom portion connecting opposite sidewalls and which have first ends pivotally attached to said base, a support member, a pair of U-shaped upper links having a bottom portion connecting opposite side-walls and which have first ends pivotally attached to said support member, a threaded collar with opposite ends pivotally attached to second ends of first ones of said pair of upper and lower links, a block member formed with a central opening and with opposite ends pivotally attached to second ends of second ones of said pair of upper and lower links, a threaded shaft which extends through said central opening of said block member and threadedly received in said threaded collar, flanges formed on said pair of lower links at edges of said sidewalls opposite the bottom portion and which are formed around said first ends and substantially all the way along said edges to said second ends, flanges formed on said pair of upper links at edges of said sidewalls opposite the bottom portion and which are formed around said first ends and substantially all the way along said edges to said second ends, said flanges of said lower links extending in a direction which is opposite to the direction of the flanges of said upper links, meshing gear teeth formed on said first ends on said flanges of said upper and lower links, and the meshing teeth on the flanges of said lower links extending in a direction which is opposite to the direction of the meshing teeth on the flanges of said upper links.*

*8. A scissors jack according to claim 7 wherein said flanges and meshing teeth of said lower links extend outwardly from said jack and flanges, and meshing teeth of said upper links extend inwardly from said jack.*

*9. A scissors jack according to claim 7 wherein said flanges and meshing teeth of said lower links extend inwardly from said jack and said flanges and meshing teeth of said upper links extend outwardly from said jack.*

*10. A scissors type jack according to claim 7 wherein the gear teeth and flanges on said lower links do not engage the gear teeth and flanges on said upper links when the jack is lowered to its lowest position.*

*11. A scissors type jack according to claim 10 wherein said gear teeth and flanges on said upper links pass inside the gear teeth and flanges on said lower links when said jack is moved to its lowest position.*

*12. A scissors type jack according to claim 10 wherein said gear teeth and flanges on said lower links pass inside the gear teeth and flanges on said upper links when said jack is moved to its lowest position.*

*13. A scissors type jack, comprising: a base, a pair of U-shaped lower links having a bottom portion connecting opposite sidewalls and which have first ends pivotally attached to said base, a support member, a pair of U-shaped upper links having a bottom portion connecting opposite sidewalls and which have first ends pivotally attached to said support member, a threaded collar with opposite ends pivotally attached to second ends of first ones of said pair of upper and lower links, a block member formed with a central opening and with opposite ends pivotally attached to second ends of second ones of said pair of upper and lower links, a threaded shaft which extends through said central opening of said block member and threadedly received in said threaded collar, flanges formed on said pair of lower links at edges of said sidewalls opposite the bottom portion and which are formed around said first ends and substantially all the way along said edges to said second ends, flanges formed on said pair of upper links at edges of said sidewalls opposite the bottom portion and which are formed around said first ends and substantially all the way along said edges to said second ends said flanges of said lower links extending in a direction which is opposite to the direction of the flanges of said upper links, meshing gear teeth formed on said first ends on said flanges of said upper and lower links, the meshing teeth on the flanges of said lower links extending in a direction which is opposite to the direction of the meshing teeth on the flanges of said upper links, and said flanges formed on said lower links and upper links terminating at said second ends so that they do not extend around said second ends.*

* * * * *